US008613637B2

(12) United States Patent
Puls et al.

(10) Patent No.: US 8,613,637 B2
(45) Date of Patent: Dec. 24, 2013

(54) WATER SURVIVAL SYSTEM AND A METHOD FOR DETECTING THE DANGER OF A PERSON DROWNING

(75) Inventors: Juergen Puls, Kirchseeon (DE); Frank Richard Fassbender, Zorneding (DE)

(73) Assignee: Juergen Puls, Kirchseeon (DE)

( * ) Notice: Subject to any disclaimer, the term of this patent is extended or adjusted under 35 U.S.C. 154(b) by 124 days.

(21) Appl. No.: 13/068,745

(22) Filed: May 18, 2011

(65) Prior Publication Data

US 2011/0294382 A1 Dec. 1, 2011

Related U.S. Application Data

(63) Continuation-in-part of application No. 12/387,690, filed on May 5, 2009, now abandoned, which is a continuation of application No. PCT/EP2007/009240, filed on Oct. 24, 2007.

(30) Foreign Application Priority Data

Nov. 6, 2006 (EP) ..... 06023041

(51) Int. Cl.
*B63C 9/00* (2006.01)

(52) U.S. Cl.
USPC ..... 441/80

(58) Field of Classification Search
USPC ..... 441/80, 83, 87–90, 92, 106, 108, 441/111–119, 122, 123, 129
See application file for complete search history.

(56) References Cited

U.S. PATENT DOCUMENTS

| | | | | |
|---|---|---|---|---|
| 5,408,222 | A | 4/1995 | Yaffe et al. | |
| 5,886,635 | A | 3/1999 | Landa et al. | |
| 6,843,694 | B2 * | 1/2005 | Simmons | 441/89 |
| 7,261,608 | B2 * | 8/2007 | Haddacks | 441/80 |

(Continued)

FOREIGN PATENT DOCUMENTS

| | | |
|---|---|---|
| CN | 2774934 | 4/2006 |
| DE | 3600802 | 7/1987 |

(Continued)

*Primary Examiner* — Daniel Venne
(74) *Attorney, Agent, or Firm* — Thomas J. Connelly; Wilhelm Law, S.C.

(57) ABSTRACT

A water survival system and a method are disclosed for detecting the danger of a person drowning in a body of water. The water survival system includes a breast belt and a life jacket. The breast belt has at least one physiological condition sensor affixed thereto while the life jacket has an expandable chamber connected to a compressed gas supply via an activating mechanism. As the compressed gas enters the expandable chamber, the life jacket increases in buoyancy. The life jacket also has a water contact sensor, a global positioning system device, first and second body orientation sensors, a transmitter which is capable of sending a signal to a remote receiver, and a control unit capable of receiving real time signals from each of the sensors and evaluating and comparing the real time signals against corresponding ranges of preset acceptable values to determine if the person wearing the life jacket is in danger of drowning. The control unit is capable of forwarding a signal to both the activating mechanism and to the transmitter when a signal from the water contact sensor indicates the person is in the water and the real time signals from the other sensors are outside of corresponding ranges of preset acceptable values. The signal to the activating mechanism opens the compressed gas supply while the signal to the transmitter is relayed to the remote receiver which sounds an audible alarm.

20 Claims, 4 Drawing Sheets

(56) References Cited

U.S. PATENT DOCUMENTS

| | | | | |
|---|---|---|---|---|
| 2001/0049241 | A1 | 12/2001 | McClure et al. | |
| 2002/0097157 | A1 | 7/2002 | Piri et al. | |
| 2005/0012663 | A1 | 1/2005 | Audren et al. | |
| 2006/0012483 | A1 | 1/2006 | Ethington | |
| 2006/0019560 | A1 | 1/2006 | Haselsteiner | |
| 2010/0167608 | A1* | 7/2010 | Daye et al. | 441/89 |

FOREIGN PATENT DOCUMENTS

| | | |
|---|---|---|
| DE | 4003683 | 8/1991 |
| DE | 9302050 | 6/1993 |
| DE | 19939302 | 2/2002 |
| JP | 02241890 | 9/1990 |
| JP | 06033797 | 5/1994 |
| JP | 2003231494 | 8/2003 |
| JP | 2004122920 | 4/2004 |
| JP | 2004145574 | 5/2004 |
| JP | 2004249956 | 9/2004 |
| JP | 2006232109 | 9/2006 |
| WO | 03026449 | 4/2003 |
| WO | 2004007276 | 1/2004 |
| WO | 2005025984 | 3/2005 |

* cited by examiner

A METHOD OF DETECTING THE DANGER OF A PERSON DROWNING IN A BODY OF WATER, SAID PERSON HAVING A PAIR OF SHOULDERS AND A PAIR OF HIPS, SAID METHOD COMPRISING THE STEPS OF:

SECURING A BREAST BELT ABOUT A CHEST OF SAID PERSON, SAID BREAST BELT HAVING A FIRST SENSOR CAPABLE OF MEASURING A REAL TIME PHYSIOLOGICAL CONDITION OF SAID PERSON WEARING SAID BREAST BELT AND PRODUCING A CORRESPONDING REAL TIME SIGNAL;

POSITIONING A LIFE JACKET ABOUT A TORSO OF SAID PERSON AND EXTERNAL TO SAID BREAST BELT, SAID LIFE JACKET HAVING A FRONT SECTION, A BACK SECTION, AND A PAIR OF SHOULDER STRAPS JOINING SAID FRONT SECTION TO SAID BACK SECTION, AT LEAST ONE OF SAID FRONT AND BACK SECTIONS HAVING A FIRST SURFACE AND A SECOND SURFACE WITH AN EXPANDABLE CHAMBER LOCATED THEREBETWEEN, A SUPPLY OF COMPRESSED GAS CONNECTED TO SAID EXPANDABLE CHAMBER, AND AN ACTIVATING MECHANISM CAPABLE OF OPENING SAID SUPPLY OF COMPRESSED GAS AND ALLOWING SAID COMPRESSED GAS TO EXPAND AND BE ROUTED TO SAID EXPANDABLE CHAMBER TO INCREASE THE BUOYANCY OF SAID LIFE JACKET;

ATTACHING A GLOBAL POSITIONING SYSTEM DEVICE TO SAID LIFE JACKET WHICH IS CAPABLE OF DETERMINING REAL TIME LONGITUDE AND LATITUDE COORDINATES OF SAID PERSON WEARING SAID LIFE JACKET AND PRODUCING CORRESPONDING REAL TIME SIGNALS;

ATTACHING A FIRST BODY ORIENTATION SENSOR TO SAID LIFE JACKET APPROXIMATE ONE OF SAID PAIR OF SHOULDERS AND ATTACHING A SECOND BODY ORIENTATION SENSOR TO SAID LIFE JACKET APPROXIMATE ONE OF SAID PAIR OF HIPS, SAID FIRST AND SECOND BODY ORIENTATION SENSORS COOPERATING TO DETERMINE REAL TIME BODY ORIENTATION VALUES OF SAID PERSON WEARING SAID LIFE JACKET AND PRODUCING CORRESPONDING REAL TIME SIGNALS;

ATTACHING A WATER CONTACT SENSOR TO SAID LIFE JACKET WHICH IS CAPABLE OF DETERMINING WHEN SAID PERSON IS IN A BODY OF WATER AND PRODUCING A CORRESPONDING REAL TIME SIGNAL;

LOCATING A RECEIVER REMOTELY AWAY FROM SAID PERSON WEARING BOTH SAID BREAST BELT AND SAID LIFE JACKET, SAID RECEIVER HAVING AN AUDIBLE ALARM CONNECTED THERETO;

ATTACHING A TRANSMITTER TO SAID LIFE JACKET WHICH IS CAPABLE OF SENDING A WIRELESS SIGNAL TO SAID RECEIVER;

ESTABLISHING RANGES OF PRESET ACCEPTABLE VALUES FOR SAID PERSON WEARING BOTH SAID BREAST BELT AND SAID LIFE JACKET, SAID RANGES OF PRESET ACCEPTABLE VALUES INCLUDING A PHYSIOLOGICAL CONDITION VALUE AND FIRST AND SECOND BODY ORIENTATION VALUES; AND

ATTACHING A CONTROL UNIT TO SAID LIFE JACKET WHICH IS CAPABLE OF RECEIVING REAL TIME SIGNALS FROM EACH OF SAID SENSORS AND EVALUATING AND COMPARING SAID REAL TIME SIGNALS AGAINST CORRESPONDING RANGES OF PRESET ACCEPTABLE VALUES TO DETERMINE IF SAID PERSON IS IN DANGER OF DROWNING, SAID CONTROL UNIT CAPABLE OF FORWARDING A SIGNAL TO BOTH SAID ACTIVATING MECHANISM AND TO SAID TRANSMITTER WHEN SAID SIGNAL FROM SAID WATER CONTACT SENSOR INDICATES THAT SAID PERSON IS ACTUALLY IN A BODY OF WATER AND WHEN SAID REAL TIME PHYSIOLOGICAL CONDITION SIGNAL AND SAID REAL TIME BODY ORIENTATION SIGNALS ARE SIMULTANEOUSLY OUTSIDE CORRESPONDING RANGES OF PRESET ACCEPTABLE VALUES, SAID SIGNAL TO SAID ACTIVATING MECHANISM OPENS SAID SUPPLY OF COMPRESSED GAS AND SAID SIGNAL TO SAID TRANSMITTER CAUSING A WIRELESS SIGNAL TO BE SENT TO SAID RECEIVER WHICH CAUSES SAID AUDIBLE ALARM TO SOUND.

FIG. 8

WATER SURVIVAL SYSTEM AND A METHOD FOR DETECTING THE DANGER OF A PERSON DROWNING

CROSS REFERENCE TO RELATED APPLICATIONS

This application is being filed under 35 U.S.C. 111(a) as a Continuation-In-Part Application of bypass Continuation-in-Part application Ser. No. 12/387,690 of May 5, 2009 under (35 U.S.C. 120 and 365(c)) of International Patent Application No. PCT/EP2007/009240 with an International Filing Date of Oct. 24, 2007, which designated the U.S., and which claims priority to European Patent Application No. 06 023041.4 filed Nov. 6, 2006. Applicant hereby certifies that International Patent Application No. PCT/EP2007/009240 has not been withdrawn.

FIELD OF THE INVENTION

The invention relates to a water survival system and a method for detesting the danger of a person drowning in a body of water.

BACKGROUND OF THE INVENTION

It is generally known that numerous people fall victim to death by drowning each year only because they got into an emergency situation that was not observed by other persons. The danger of drowning exists in many places, for example in the ocean, in the sea, in lakes, in rivers, in ponds, or in public and private swimming pools. In a number of these cases, a rescue could have been possible if the emergency situation was observed by other persons and a corresponding rescue action was initiated. Often a few minutes or even seconds determines the difference between life and death of the person in danger.

Today, there exist several devices and methods that can assist in saving a person from drowning. U.S. Patent Application Publication 2006/0019560 A1, filed by Haselsteiner, describes one such device and method. Haselsteiner's application, entitled: "PERSONAL FLOTATION DEVICE AND METHOD FOR SAME", teaches a device which is a personal floatation apparatus having a sleeve, an inflatable bladder, a gas canister, an opening mechanism and a heart monitor in communication with the opening mechanism. When the heart monitor detects a heart rate outside of a predetermined range, a signal is sent to the opening mechanism to release the gas and inflate the bladder. Although the Haselsteiner device and method is useful in certain emergency situations, it will not prevent a person from drowning under all circumstances. In life-threatening situations, people react differently. For example, depending upon the situation and nature of the affected person, monitoring only a person's heart rate may not be adequate to determine if the person is in immediate danger of drowning. It would be more advantageous to monitor at least one physiological condition of the person along with simultaneously monitoring the person's body orientation. Such a water survival system and method would provide a more definite indication if a person was in immediate peril of drowning in a body of water. For an optimal certitude, there are still other body signals which could be measured and/or monitored to positively detect that a person is in immediate danger of drowning in a body of water.

For such water survival systems and methods to function reliably in all thinkable situations, the water survival system and method should not only measure and transfer data of the bodily constitution of a person in danger of drowning to a place of surveillance but the device and method should be able to automatically increase the buoyancy of a life jacket to cause the head of the person in danger to be elevated above the surface of the body of water so that the person can breathe. Applicants are not aware of any water survival system or method that is capable of doing this at the present time.

Therefore, there is a need for a water survival system and method that is more reliable in preventing a person from drowning in various situations. The ability to rescue life would rise considerably. Children are most likely to drown for they lack the experience to quickly recognize the gravity of a perilous situation. However, many older persons whose perceptiveness and reaction time has been reduced due to their advanced age, deterioration of mental awareness, and/or diminished dexterity, would also benefit from such a device and method.

SUMMARY OF THE INVENTION

Briefly, this invention relates to a water survival system and a method for detecting the danger of a person drowning in a body of water. The person has a pair of shoulders and a pair of hips. The water survival system includes a breast belt capable of being opened and closed to secure the breast belt about a chest of the person. The breast belt has a first sensor capable of measuring a real time physiological condition of the person wearing the breast belt and producing a corresponding real time signal. The water survival system also includes a life jacket positioned about a torso of the person and located external to the breast belt. The life jacket has a front section, a back section, and a pair of shoulder straps joining the front section to the back section. At least one of the front and back sections of the life jacket has a first surface and a second surface with an expandable chamber located therebetween. A supply of compressed gas is connected to the expandable chamber and an activating mechanism is present which is capable of opening the supply of compressed gas and allowing the compressed gas to expand and be routed to the expandable chamber to increase buoyancy of the life jacket. The water survival system also includes a global positioning system device attached to the life jacket which is capable of determining real time longitude and latitude coordinates of the person wearing the life jacket and producing corresponding real time signals. The water survival system further includes a first body orientation sensor attached to the life jacket and located approximate one of the pair of shoulders and a second body orientation sensor attached to the life jacket and located approximate one of the pair of hips. The first and second body orientation sensors cooperate to determine real time body orientation values for the person wearing the life jacket and producing a corresponding real time signal. The water survival system also has a water contact sensor attached to the life jacket which is capable of determining when the person is in a body of water and producing a corresponding real time signal. A receiver is located remotely away from the person wearing both the breast belt and the life jacket. The receiver has an audible alarm connected thereto. A transmitter is attached to the life jacket and is capable of sending a signal to the receiver. The water survival system also has a control unit attached to the life jacket which is capable of receiving real time signals from each of the sensors and comparing the real time signals against corresponding ranges of preset acceptable values to determine if the person wearing both the breast belt and the life jacket is in danger of drowning. The control unit is capable of forwarding a signal to both the activating mechanism and to the transmitter when the signal from the water contact sensor indicates that the person is actually in a body of water and when the other two real time signals are simultaneously outside corresponding ranges of preset acceptable values. The signal to the activating mechanism opens the supply of compressed gas and the signal to the transmitter is then forwarded to the receiver which sounds the audible alarm. The water survival system further includes a source of energy connected to each of the sensors, to the activating mechanism, to the global positioning system device, and to the control unit to allow each to operate for an extended period of time.

In another embodiment, the water survival system includes a breast belt capable of being opened and closed to secure the breast belt about a chest of the person. The breast belt has a pulse sensor and a breathing sensor affixed thereto. The pulse sensor is capable of measuring real time pulse frequencies of the person wearing the breast belt and producing a corresponding real time signal and the breathing sensor is capable of measuring real time breathing frequencies of the person wearing the breast belt and producing a corresponding real time signal. The water survival system also includes a life jacket positioned about a torso of the person and located external to the breast belt. The life jacket has a front section, a back section, and a pair of shoulder straps joining the front section to the back section. At least one of the front and back sections of the life jacket has a first surface and a second surface with an expandable chamber located therebetween. A supply of compressed gas is connected to the expandable chamber and an activating mechanism is present which is capable of opening the supply of compressed gas and allowing the compressed gas to expand and be routed to the expandable chamber to increase buoyancy of the life jacket. The water survival system also includes a global positioning system device attached to the life jacket which is capable to determining real time longitude and latitude coordinates of the person wearing the life jacket and producing corresponding real time signals. The water survival system further includes a first body orientation sensor attached to the life jacket and located approximate one of the pair of shoulders and a second body orientation sensor attached to the life jacket and located approximate one of the pair of hips. The first and second body orientation sensors cooperate to determine real time body orientation values for the person wearing the life jacket and producing a corresponding real time signal. The water survival system also has a water contact sensor attached to the life jacket which is capable of determining when the person is in a body of water and producing a corresponding real time signal. A receiver is located remotely away from the person wearing both the breast belt and the life jacket. The receiver has an audible alarm connected thereto. A transmitter is attached to the life jacket and is capable of sending a signal to the receiver. The water survival system also has a control unit attached to the life jacket which is capable of receiving real time signals from each of the sensors and comparing the real time signals against corresponding ranges of preset acceptable values to determine if the person wearing both the breast belt and the life jacket is in danger of drowning. The control unit is capable of forwarding a signal to both the activating mechanism and to the transmitter when the signal from the water contact sensor indicates that the person is actually in a body of water and when the other two real time signals are simultaneously outside corresponding ranges of preset acceptable values. The signal to the activating mechanism opens the supply of compressed gas and the signal to the transmitter is then forwarded to the receiver which sounds the audible alarm. The water survival system further includes a source of energy connected to each of the sensors, to the activating mechanism, to the global positioning system device, and to the control unit to allow each to operate for an extended period of time.

This invention also relates to a method of detecting the danger of a person drowning in a body of water. The person has a pair of shoulders and a pair of hips. The method includes the steps of securing a breast belt capable of being opened and closed about a chest of the person. The breast belt has a first sensor capable of measuring a real time physiological condition of the person wearing the breast belt and producing a corresponding real time signal. The method also includes positioning a life jacket about a torso of the person and external to the breast belt. The life jacket has a front section, a back section, and a pair of shoulder straps joining the front section to the back section. At least one of the front and back sections has a first surface and a second surface with an expandable chamber located therebetween. A supply of compressed gas is connected to the expandable chamber and an activating mechanism is present which is capable of opening the supply of compressed gas and allowing the compressed gas to expand and be routed to the expandable chamber to increase the buoyancy of the life jacket. A global positioning system device is also attached to the life jacket which is capable to determining real time longitude and latitude coordinates of the person wearing the life jacket and producing corresponding real time signals. First and second body orientation sensors are also attached to the life jacket. The first body orientation sensor is located approximate one of the pair of shoulders and the second body orientation sensor is located approximate one of the pair of hips. The first and second body orientation sensors cooperate to determine real time body orientation values of the person wearing the life jacket and producing a corresponding real time signal. The device also has a water contact sensor attached to the life jacket which is capable of determining when the person is in a body of water and producing a corresponding real time signal.

A receiver is remotely located away from the person wearing both the breast belt and the life jacket. The receiver has an audible alarm connected thereto. The method further includes attaching a transmitter to the life jacket which is capable of sending a wireless signal to the receiver. The method also includes establishing corresponding ranges of preset acceptable values for the person wearing both the breast belt and the life jacket. The ranges of preset acceptable values include a range of a physiological condition value and a range of first and second body orientation values. A control unit is also attached to the life jacket and is capable of receiving real time signals from each of the sensors and comparing the real time signals against corresponding ranges of preset acceptable values to determine if the person wearing both the breast belt and the life jacket is in danger of drowning. The control unit is capable of forwarding a signal to both the activating mechanism and to the transmitter when the signal from the water contact sensor indicates that the person is actually in a body of water and when the other two real time signals are simultaneously outside corresponding ranges of preset acceptable values. The signal to the activating mechanism opens the supply of compressed gas and the signal to the transmitter causing a wireless signal to be sent to the receiver which causes the audible alarm to sound.

BRIEF DESCRIPTION OF THE DRAWINGS

FIG. 8 is a flow diagram showing the method of the invention.

DETAILED DESCRIPTION OF THE INVENTION

Figure 1:
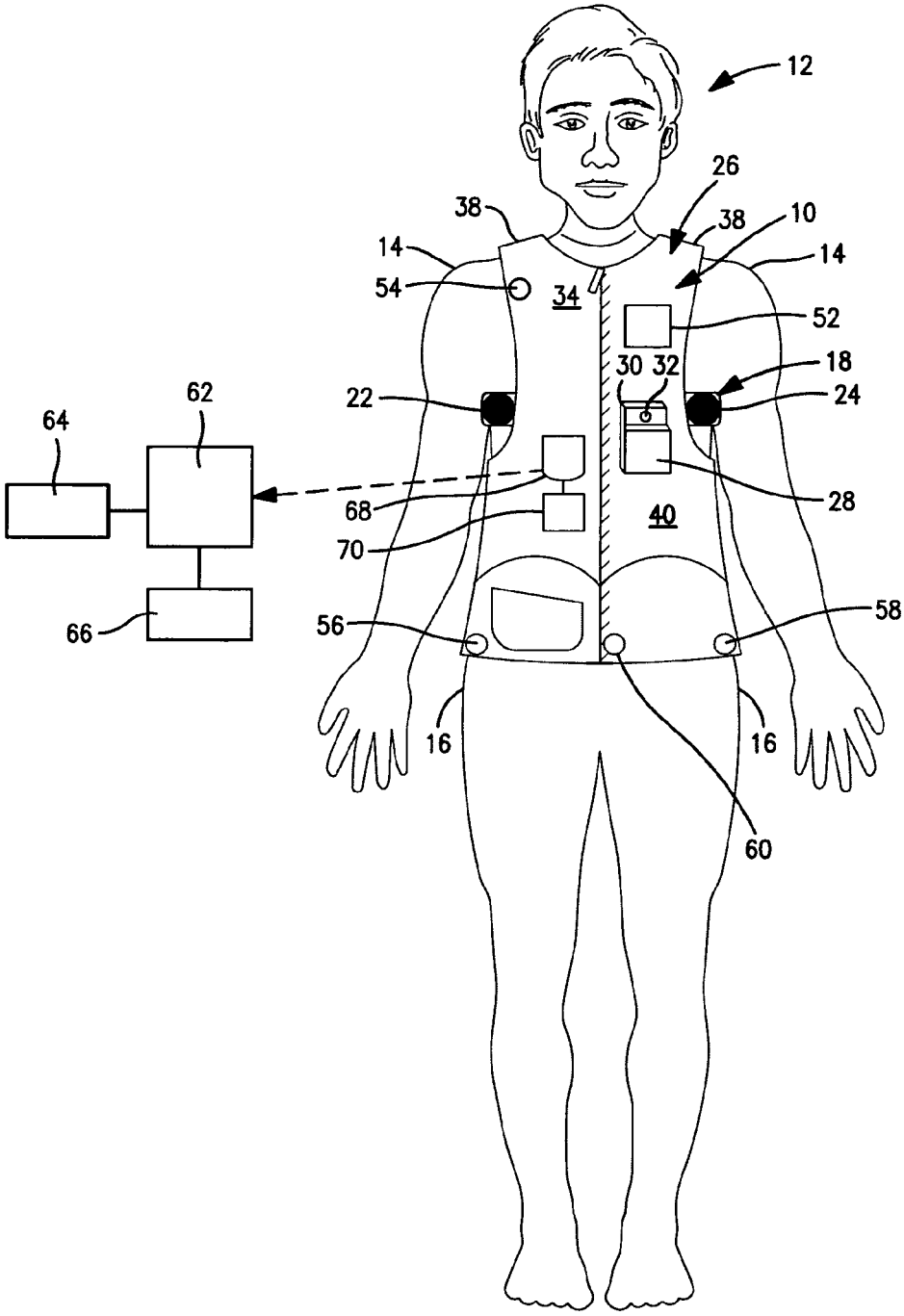
FIG. 1 is a schematic illustration of the front of a person wearing a water survival system for detecting the danger of drowning in a body of water.
Figure 2:
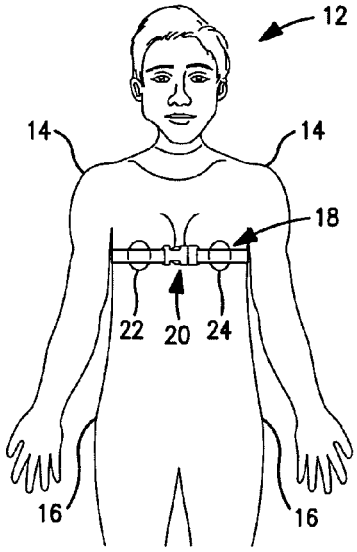
FIG. 2 is a schematic illustration of the front of a person wearing a breast belt which has a pulse sensor and a breathing sensor secured thereto.

Referring to FIGS. 1-4, a water survival system 10 is shown which is capable of detecting the danger of a person 12 drowning in a body of water. The person 12 has a pair of shoulders 14, 14 and a pair of hips 16, 16. The water survival system 10 includes a breast belt 18, best shown in FIGS. 2 and 3, which includes an opening/closing mechanism 20 which is capable of being opened and closed to secure the breast belt 18 about a chest of the person 12. By "chest" it is meant that part of a human body that is located between the neck and the abdomen, enclosed by the ribs and the breastbone. The opening/closing mechanism 20 can vary in configuration. For example, the opening/closing mechanism 20 can be a buckle. By "buckle" it is meant a clasp for fastening two ends, as of a belt, in which a device attached to one of the ends is fitted or coupled to the other. The opening/closing mechanism 20 can also consist of cooperating male and female connectors, a fastening mechanism, a button which engages with a button hole, a zipper, etc.

The breast belt 18 has a first sensor 22 secured, affixed or attached thereto which is capable of measuring a real time physiological condition of the person 12 wearing the breast belt 18 and producing a corresponding signal. By "physiological condition" it is meant measuring a body function or process such as: pulse frequency, breathing frequency, heart rate, etc. By "pulse" it is meant the rhythmical throbbing of arteries produced by the regular contractions of the heart. By "breathing" it is meant the act or process of respiration, inhaling and exhaling air. By "heart rate" it is meant the sequential pulsations of the heart over a set period of time as it pumps blood through the entire circulatory system. Desirably, the breast belt 18 contains a second sensor 24 which is capable of measuring a different real time physiological condition of the person 12 wearing the breast belt 18 and producing a corresponding signal. The two sensors 22 and 24 can be spaced apart from one another. The distance between each of the sensors 22 and 24 can vary depending upon whether the two sensors 22 and 24 are placed on a child or on an adult, or if the sensors 22 and 24 are placed on a man or a woman. The two sensors 22 and 24 should be positioned on the chest, one to the left and the other to the right. One of the sensors 22 and 24 can be placed approximate the left lung and the other approximate the right lung. Alternatively, one of the sensors can be positioned approximate the heart.

It should be understood that at least one sensor 22 should be present on the breast belt 18. However, two or more sensors can be utilized, if desired. The breast belt 18 can easily accommodate three, four, five or more sensors depending upon the size and configuration of the various sensors. Most sensors have a maximum dimension of about two (2) inches or less and weigh only a few ounces. Desirably, each of the first and second sensors, 22 and 24 respectively, weighs less than about 8 ounces: More desirably, each of the first and second sensors, 22 and 24 respectively, weighs less than about 5 ounces. Even more desirably, each of the first and second sensors, 22 and 24 respectively, weighs less than about 4 ounces. In addition, each of the first and second sensors, 22 and 24 respectively, can be a circular disc having a maximum dimension of about 1.5 inches or less.

The first sensor 22 can be a pulse sensor which is capable of measuring real time pulse frequencies of the person 12 wearing the breast belt 18. Various styles of pulse sensors are commercially available. A suitable pulse sensor which works well is model number S810i, commercially available from Polar Electro GmbH of Buettelborn, Germany. The pulse sensor should be designed to continuously measure the pulse frequency of the person 12 and produce a corresponding continuous signal. The second sensor 24 can be a breathing sensor which is capable of measuring real time breathing frequencies of the person 12 wearing the breast belt 18 and produce a corresponding continuous signal. Various styles of breathing sensors 24 are commercially available. A suitable breathing sensor which works well is commercially available from SimTest—Bruno Zak, Simbach/Inn in Germany. The breathing sensor 24 should be designed to continuously determine whether the person 12 in the water is breathing and at what frequency. Desirably, the breathing sensor 24 is capable of measuring breathing frequency based on both abdominal and breast breathing of the person 12 wearing the breast belt 18 and producing a corresponding continuous signal.

Optionally, the breathing sensor 24 can be formed in the opening/closing mechanism 20, i.e. in the buckle, of the breast belt 18. For example, the sensing element can be cast into a pin of the buckle. The breathing sensor 24 may include a piezo element responding to the micro bending of the pin caused by breathing. The breathing sensor 24 may detect both the abdominal breathing and the breast breathing. By observing the breathing frequency of the person 12, one can determine if an emergency situation exist. Such an emergency normally manifests itself in two different ways. In one way, there occurs an apnea during a faint or the drowning of the person 12. In the other way, a panic or an anxiety leads to an extreme fast breathing or hackling by the person 12.

Figure 4:
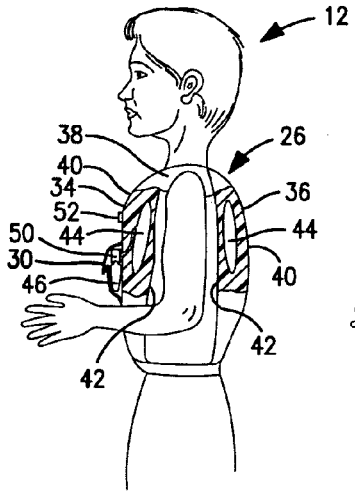
FIG. 4 is a side view of the schematic illustration shown in FIG. 1 and showing a life jacket partially in cross-section to reveal two expandable chambers which increase the buoyancy of the life jacket when they are filled with a pressurized gas.
Figure 5:
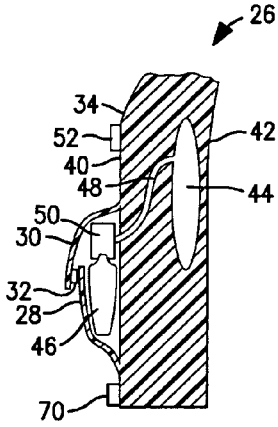
FIG. 5 is an enlarged cross-sectional view of a portion of the front of the life jacket shown in FIG. 4 depicting a pocket for retaining a compressed gas cylinder and an activation mechanism which is connected by a conduit to the expandable chamber.

Referring now to FIGS. 1, 4 and 5, the water survival system 10 also includes a life jacket 26. By "life jacket" it is meant a life preserver in the form of a vest, a jacket or of some other shape. Although the life jacket 26 is depicted as a sleeveless vest or jacket, it should be understood by those skilled in the art that the life jacket 26 could contain sleeves, a neck collar, etc., if desired The size, shape and configuration of the life jacket 26 can vary. The life jacket 26 can also include one or more pockets 28 for holding or retaining various items. The pocket 28 can optionally include a cover flap 30 which can overlap and/or be secured to an outer portion of the pocket 28 by an attachment mechanism 32. The attachment mechanism 32 can vary in configuration. For example, the attachment mechanism 32 can be a Velcro attachment, a hook and loop attachment, a button and cooperating button hole, a two fastening mechanisms, such as a pair of snaps, a zipper, etc.

Since the water survival system 10 includes a breast belt 18 and a life jacket 26 it can be viewed as a combination. The breast belt 18 should be secured about the chest of the person 12 before the life jacket 26 is placed about the person's torso. By "torso" it is meant the trunk of a human body excluding the head and limbs. The life jacket 26 is positioned about the torso such that it is located external to the breast belt 18. The reason for this is that the first and/or second sensors, 22 and 24 respectively, should be in direct or close contact with the person's skin in order to obtain reliable signals. Alternatively, the first and second sensors, 22 and 24 respectively, can be positioned on the outer surface of a swim suit, a wet suit, a diving suit, etc., because such suits are relatively thin in thickness and should not interfere with reliable signals being measured by the first and second sensors, 22 and 24 respectively.

Still referring to FIGS. 1, 4 and 5, the life jacket 26 has a front section 34, a back section 36, and a pair of shoulder straps 38 joining the front section 34 to the back section 36. At least one of the front and back sections, 34 and 36 respectively, of the life jacket 26 has a first surface 40 and a second surface 42 with an expandable chamber 44 located therebetween, see FIGS. 4 and 5. Two or more separate and distinct expandable chambers 44, 44 can be formed in the life jacket 26. In FIG. 4, two separate and distinct expandable chambers 44, 44 are shown. In other words, the expandable chamber 44 or chambers 44, 44 are integrated into the life jacket 26. Alternatively, the expandable chamber 44 can be secured to the front and/or back sections, 34 and 36 of the life jacket 26. In still another alternative, the expandable chamber 44 is integrated into another piece of clothing worn by the person 12. Sometimes, it may be advantageous to divide the expandable chamber 44 into several spaces or zones or to form the expandable chamber 44 from a plurality of elongated tubes. In either case, the expandable chamber 44 or chambers 44, 44 are dimensioned in such a way and located in the life jacket or an adjacent piece of clothing in such a manner that after the expandable chamber 44 or chambers 44, 44 are filled with a pressurized gas, it will impart a sufficient buoyancy to lift up the person 12 in a body of water such that the person's 12 head will be positioned above the surface of the water. One skilled in the art can calculate how much buoyancy is needed to lift a person of a certain weight up in either fresh water or salt water so that the person's head is above the surface of the water.

Desirably, both the front section 34 and the back section 36 of the life jacket 26 contains an expandable chamber 44, see FIG. 4. When the front section 34 and the back section 36 are integrally connected, a single expandable chamber 44 can be present which extending into both sections. A life jacket containing an expandable chamber 44 is commercially available from the Globetrotter Company, having a business office at Bargkoppelstieg 10-14, 22145 Hamburg, Germany.

A container or supply of compressed gas 46 is connected to the expandable chamber 44 or chambers 44, 44 by a conduit 48. The container or supply of compressed gas 46 can be any size, type or configuration of container, canister or receptacle known to those skilled in the art. Desirably, the container or supply of compressed gas 46 is a metal cylindrical canister having a diameter of about 1 inch or less and a length of about 4 inches or less. The weight of the canister of compressed gas 46 can vary but normally is less than a pound.

The compressed gas stored in the container 46 can be any gas known to those skilled in the art, including air, hydrogen, oxygen, nitrogen, helium, etc., or a combination of two or more gases. For cost reasons and in order to protect the environment, the compressed gas can be air. By "compressed gas" it is meant that the gas is under greater than atmospheric pressure. A suitable container or supply of compressed gas 46 is commercially available from the SKS Company. SKS sells air gun cartridges, model number 84140071, manufactured in Kronberg, Germany. The container or supply of compressed gas 46 is formed such that a predetermined amount of the compressed gas is released upon activation into the conduit 48. The exact pressure of the compressed gas can vary. One skilled in the art will be able to calculate what a desired pressure should be depending on the area of the expandable chamber 44 and the time in which one wants to fill the expandable chamber 44.

The container or supply of compressed gas 46 can be sized to easily fit in one of the pockets 28 formed in the life jacket 26, see FIG. 5.

Referring again to FIGS. 4 and 5, the water survival system 10 further includes an activating or opening mechanism 50 which is secured to an end or portion of the container or supply of compressed gas 46. The activating mechanism 50 can be activated in a number of ways. For example, the activating mechanism 50 can be electrically activated. Alternatively, the activating mechanism 50 can be pyrotechnically activated. By "pyrotechnically activated" it is meant that an explosion, a chemical meltdown, a firework, etc. can be used to open the container or supply of compressed gas 46. For example, the activating mechanism 50 can consist of a membrane which closes off one end of the container or supply of compressed gas 46. This membrane can be removed, be punctured, be pierced, be opened, be melted, be softened so it will break, etc., so that the compressed gas can escape. By exposing the membrane to heat, so as to soften or melt it, one may be able to form an aperture in the membrane which in turn will allow the compressed gas to escape and be routed through the conduit 48 and into the expandable chamber 44. The heat required to soften or melt the membrane can be provided by an electric charge, by a chemical reaction, by mechanical contact with a pin or needle, or by some other means known to those skilled in the art. By puncturing, piercing, removing, opening, softening or melting the membrane, one can form an aperture through which the compressed gas can be released from its container 46. The activating mechanism 50 should be designed to open the container or supply of compressed gas 46 instantaneously.

The activating mechanism 50 is capable of opening the container or supply of compressed gas 46 quickly and allowing the compressed gas to expand and be routed to the expandable chamber 44 to increase buoyancy of the life jacket 26. By "buoyancy" it is meant the tendency or capacity to remain afloat in a liquid, such as water. Various activating mechanisms 50 are commercially available which utilize a pin or needle which can be inserted into one end of the canister so that a puncher hole or aperture is formed and the compressed gas can rapidly escape. The expanding gas leaving the canister will quickly fill the conduit 48 and be routed to the expandable chamber 44 and inflate it. The exact amount of time it will take to fill and expand the expandable chamber 44 can vary but generally only takes a few seconds. Desirably, the expandable chamber 44 is filled in about one second. More desirably, the expandable chamber 44 is filled in less than one second. The size, shape and dimensions of the expandable chamber 44 and the actual pressure value of the compressed gas needed to inflate the expandable chamber 44 have to be accounted for in designing the life jacket 26. Such engineering calculations are readily apparent to those skilled in the art.

Returning again to FIG. 1, the water survival system 10 further includes a global positioning system (GPS) device 52 attached to the life jacket 26. The global positioning system (GPS) device 52 can utilize any type or combination of terrestrial, satellite, cellular technology, and/or components (e.g., digital or analog, the Iridium system, cell phones, pagers, paging chips, etc.). The global positioning system (GPS) device 52 can be configured to transmit and/or receive position data via a wireless communication link. The global positioning system (GPS) device 52 can determine the location of the device 52 or coordinate values of the device 52 relative to a predetermined reference point. Desirably, the global positioning system (GPS) device 52 is attached to the front section 34 of the life jacket 26. The global positioning system (GPS) device 52 is capable of determining real time longitude and latitude coordinates of the person 12 wearing the life jacket 26 and producing corresponding signals. The global positioning system (GPS) device 52 functions on the same principles as GPS navigation devices used in cars, trucks, boats and planes, and should be familiar to those skilled in the art. Many different kinds and types of global positioning system (GPS) devices are commercially available on the market today. Some are so precise that they can determine the exact location of a person anywhere on earth within three feet of given coordinates. A global positioning system (GPS) device 52 that works well in the water survival system 10 is commercially available from Garmin, GPS GmbH, having a mailing address at Lochhamer Schlag 5a, 82166 Gräfelfing in the Federal Republic of Germany. The global positioning system (GPS) device 52 operates as a conventional GPS and has a GPS receiver and/or transmitter attached to the life jacket 26. The receiver and/or transmitter can continuously detect and monitor the actual position of the person 12 at all times.

The water survival system 10 also includes a first body orientation sensor 54 and a second body orientation sensor 56 which are both attached to the life jacket 26. The first body orientation sensor 54 is located approximate one of the pair of shoulders 14, 14, and the second body orientation sensor 56 is located approximate one of the pair of hips 16, 16. Desirably, the first body orientation sensor 54 is spaced at least about 12 inches away from the second body orientation sensor 56. More desirably, the first body orientation sensor 54 is spaced at least about 15 inches away from the second body orientation sensor 56. Even more desirably, the first body orientation sensor 54 is spaced at least about 20 inches away from the second body orientation sensor 56. The first and second body orientation sensors, 54 and 56 respectively, cooperate to determine real time body orientation values for the person 12 wearing the life jacket 26 and produce a corresponding signal. This is accomplished by monitoring of the body orientation of the person 12 in the water by simultaneous reference to the two body orientation sensors 54 and 56. Body orientation sensors are commercially available from a company in Germany named Sim Test-Bruno Zak. The first and second body orientation sensors, 54 and 56 respectively, can continuously monitor and determine the orientation of the body of the person 12 while in a body of water. One can tell by receiving the simultaneous signals from the first and second body orientation sensors, 54 and 56 respectively, if the person is in a vertical orientation, with the pair of shoulders 14, 14 positioned vertically above the pair of hips 16, 16; or if the person is in a horizontal orientation, with the pair of shoulders 14, 14 being in the same plane or evenly positioned relative to the pair of hips 16, 16; or in any other possible body position. The first and second body orientation sensors, 54 and 56 respectively, can quickly determine if the person 12 is in an upright position, a supine position, a sinistral position, a dexter position, in an upside down position, as well as any intermediate positions.

The first body orientation sensor 54 can operate at an identical or at a different voltage level from the second body orientation sensor 56. Desirably, the first body orientation sensor 54 operates at a different voltage level than the second body orientation sensor 56. This will assure that one can distinguish from which of the first and second body orientation sensors, 54 and 56 respectively, an incoming signal came from. Furthermore, each of the first and second body orientation sensors, 54 and 56 respectively, should be designed to operate at a voltage level of from between about 0 to about 6 volts: Desirably, each of the first and second body orientation sensors, 54 and 56 respectively, should be designed to operate at a voltage level of from between about 0 to about 5 volts. More desirably, each of the first and second body orientation sensors, 54 and 56 respectively, should be designed to operate at a voltage level of from between about 0 to about 4 volts.

Referring again to FIG. 1, the water survival system 10 further includes a water contact sensor 58 attached to the life jacket 26. The water contact sensor 58 is capable of determining a real time value indicating if the person 12 wearing the life jacket 26 is in a body of water and producing a corresponding signal. The water contact sensor 58 detects whether the person 12 is actually in the water. Various water contact sensors 58 are commercially available today. Many water contact sensors 58 function by using an open circuit which can be closed by contact with electrically conducting water. The water contact sensor 58 may be formed as a switch or a foil. The foil includes two separate contacts being by-passed when in contact with water. Electrical current may flow through this conductor bridge such that the water contact sensor 58 operates. A suitable water contact sensor 58 is commercially available from the Conrad Elektronik Company, in Hirschau, Germany. Item number 750201-62 covers the switch and item number 610373-62 covers the foil. The water contact sensor 58 is electronically connected, either by an electrical lead or by a wireless connector to a control unit 70. The control unit 70 will evaluate and compare incoming signals from the water contact sensor 58 and send a signal to the transmitter.

Still referring to FIG. 1, the water survival system 10 can optionally include a water pressure sensor 60 which is capable of determining a real time value indicating a water depth of the person 12 wearing the life jacket 26 when in a body of water. The water pressure sensor 60 can be secured to the life jacket 26 at approximately the pair of hips 16, 16 of the person 12. The water pressure sensor 60 determines the depth below the surface of the water at which the person 12 is currently at. Optionally, the water pressure sensor 60 may also be capable of determining a real time value indicating a sinking speed of the person 12 wearing the life jacket 26 when actually sinking downward in a body of water. Various water pressure sensors 60 are commercially available today. A suitable water pressure sensor 60 is available from Conrad Elektronik Company, Claus-Conrad-Str. 1 92240 in Hirschau, Germany. This water pressure sensor 60 can continuously measure the water depth in which the person 12 is located and also the sinking speed of the person 12, when appropriate. The water depth and the sinking speed of the person 12 are independent quantities relative to the other measured quantities of the body condition of the person 12, such as pulse frequency. However, these independent quantities provide important information concerning the extent of the danger of drowning for the person 12.

Referring again to FIG. 1, the water survival system 10 further includes a receiver 62 located remotely away from the person 12 wearing both the breast belt 18 and the life jacket 26. The receiver 62 can be located a distance away from the body of water. The receiver 62 can be located in a dispatch office, in a fire station, in a police station, in a medical office, in lifeguard station, in a boat, in a plane, etc. The receiver 62 can be a hand held device or be a stationary unit. The receiver 62 can be a mobile telephone, a cell phone, an I-phone, a desktop computer, a laptop computer, an I-pad, etc. The receiver 62 has an audible alarm 64 connected thereto or integrally formed therewith. The audible alarm 64 is capable of sounding a high decibel noise when an incoming signal is outside of a range of preset acceptable values. The alarm 64 can be a loud, high-pitched tone or sound. For example, the alarm 64 can be a piercing sound, a shrill, a repetitive sound like that emitted from an ambulance, a fire truck, a police car, etc. A bright light or a flashing light can accompany the audible alarm 64, if desired. In addition, the receiver 62 can also include a visual display 66 connected to or integrally formed therewith. The visual display 66 can visually depict the incoming signals on a monitor or plot the incoming signals on graph paper so that a permanent record can be maintained. A rescuer, a safety officer, a life guard, a parent or some other adult can be in constant contact with the receiver 62. When the receiver 62 activates the alarm 64, this enables the initiation of immediate aid actions for rescuing the person 12 in danger of drowning.

Still referring to FIG. 1, the water survival system 10 also includes a transmitter 68 attached to the life jacket 26. The transmitter 68 is capable of sending a signal, either at preset time intervals or continuously, to the receiver 62. The receiver 62 is capable of receiving such signals. The transmitter 68 can be a UHF transmitter or a VHF transmitter. UHF stands for "Ultra High Frequency" and designates the radio frequency range of electromagnetic waves between 300 megahertz (MHz) and 3 gigahertz (GHz) or 3,000 MHz. UHF is also known as the decimeter band or decimeter wave as the wavelengths range from one to ten decimeters (10 cm to 1 meter). VHF stands for "Very High Frequency" and designates the radio frequency range of electromagnetic waves between 30 MHz and 300 MHz. By "megahertz" it is meant one million hertz. Megahertz is especially used as a radio-frequency unit. By "gigahertz" it is meant a unit of frequency equal to one billion ($10^9$) hertz. Frequencies immediately below VHF are denoted as High Frequency (HF). Frequencies directly above VHF are known as Ultra High Frequency (UHF). The frequency allocation is done by the International Telecommunication Union (ITU). Many different kinds and types of transmitters 68 are commercially available today. One transmitter that works well in this invention is commercially available from the Conrad Elektronik Company, Claus-Conrad-Str. 1, 92240 in Hirschau, Germany. This transmitter 68 is able to transfer the critical signals from a control unit 70 to the distant receiver 62 using radio waves.

It should be understood that the transmitter 68 can send intermittent signals or a continuous stream of signals to the receiver 62. Upon receipt of the signals by the receiver 62, the signals can be visually displayed, such as on a monitor. The incoming signals to the receiver 62 can also be stored in an electronic data base so that they can be subsequently retrieved. The stored signals can be matched to the exact time they are received. The date and time can be designated by calendar date, hour, minutes and seconds.

Still referring to FIG. 1, the water survival system 10 further includes a control unit 70 attached to the life jacket 26. The control unit 70 is capable of continuously receiving real time signals from each of the sensors 22, 24, 54, 56, 58 and 60 and comparing these real time signals against corresponding ranges of preset acceptable values. The control unit 70 is also capable of continuously receiving real time signals from the global positioning system (GPS) device 52. The control unit 70 will evaluate and compare each incoming signal that is received against a range of preset acceptable values. By "evaluate" it is meant to examine the incoming signal and ascertain its value. By "compare" it is meant to consider if an incoming signal is similar, equal or analogous with a preset acceptable value. Each of the preset acceptable values is taken of the person 12 before he or she enters the body of water and an acceptable range of preset acceptable values is generated from such values. The corresponding ranges of preset acceptable values can be determined minutes, hours, days, weeks, months or even years before the person 12 enters the body of water. Each range of preset acceptable values will correspond to one of the bodily function signals or bodily process signals now being monitored. For example, the pulse frequency, the breathing frequency, the heart rate, and the first and second body orientations of the person 12 will be taken when the person 12 is standing up and is on land. These values will establish a baseline for each range of preset acceptable values. The person 12 may then be asked to vigorously exercise so that his or her bodily function signals and bodily process signals will be elevated to provide additional values when the body is stressed. Alternatively, such additional values can be computer generated based upon measurements of a large group of people of the same gender, age, weight, height, physical condition, etc. The baseline values and the additional values will produce a range of preset acceptable values for each of the signals now being monitored. For example, the person 12 may have a non-stressed heart rate of 65 beats per minute and a stressed heart rate of 120 beats per minute The range of acceptable heart beats could be preset from 65 to 120 beats per minute. If the incoming signal from the person 12, when he or she is in a body of water, falls outside of this range, either above or below the preset acceptable range, the receive 62 will cause the audible alarm 64 to sound. Alternatively, one or more of each of the ranges of preset acceptable values can be set such that an incoming signal must exceed the top value of the range before the receiver 62 causes the audible alarm 64 to sound. In other words, the lower value of a particular range of preset acceptable values is immaterial in this situation. The decision of what the actual range of preset acceptable values should be is specifically set for each person. Each range of preset acceptable values can be set by a medical doctor, a team of medical personnel, a parent, an instructor, etc. The decision for each of the ranges of preset acceptable values can be made in conjunction with the person 12 who's range is being set. Alternatively, a licensed safety instructor can be selected to set the preset acceptable values.

The control unit 70 can also be designed to store all of the incoming signals. The control unit 70 can evaluate and compare the incoming signals from the various sensors 22, 24, 54, 56, 58 and 60 against corresponding ranges of preset acceptable values. Such incoming signals can be stored on a microchip or other storage device known to those skilled in the art. By means of a data processing program which can be developed by a person skilled in the art with knowledge of the desired function, the signals received by the control unit 70 can be instantaneously and continuously compared to each of the ranges of preset acceptable values. When a condition is detected by the control unit 70 in which one or more of the ranges of preset acceptable values are exceeded or are outside of the desired range, a signal is sent via the transmitter 68 to the receiver 62 to alert the person monitoring the person 12 in the water. The audible alarm 64 is also sounded to notify all people within hearing range that an emergency situation exist. Simultaneously, the control unit 70 will send a signal to the activating mechanism 50 so that compressed gas can be routed through the conduit 48 to the expandable chamber 44 and cause the life jacket 26 to inflate.

The incoming signals received by the control unit 70 include information on: whether the person 12 is in a body of water, detected by the water contact sensor 58; the pulse frequency of the person 12, detected by the pulse sensor 22; the actual position of the person 12 in a body of water, detected by the global positioning system (GPS) device 52; the fact that a source of energy is working, detected by input from each of the batteries (which will be explained below); the breathing frequency of the person 12, detected by the breathing sensor 24; the body orientation of the person 12 in a body of water, detected by the first and second body orientation sensors, 54 and 56 respectively; and optionally the depth and/or sinking speed of the person 12 in a body of water, detected by the water pressure sensor 60.

The control unit 70 is capable of forwarding a signal to both the activating mechanism 50 and to the transmitter 68 when the signal from the water contact sensor 58 indicates that the person 12 is actually in a body of water, and when one of the two real time physiological condition signals 22 or 24, and the combination of the body orientation signals 54 and 56, are simultaneously outside corresponding ranges of preset acceptable values. The signal to the activating mechanism 50 opens the supply of compressed gas and the signal to the transmitter 68 is forwarded to the receiver 62 which sounds the audible alarm 64. In other words, when the control unit 70 detects that the person 12 is in the water (signal from the water contact sensor 58), and either the pulse or breathing sensors, 22 and 24, is not within the range of preset acceptable values, and the first and second body orientation sensors, 54 and 56 respective, indicate the position of the person 12 has changed, the activating mechanism is triggered and compressed gas is routed to the expandable chamber 44. This will immediately inflate the life jacket 26 and its buoyancy will cause the person 12 to be lifted to the surface of the water. The person 12 should then be able to breathe until help arrives. If two or more of the signals from the sensors 22 or 24, the signal from the first and second body orientations sensors, 54 and 56 respectively, and the signal from the water pressure sensor 60 are outside of the corresponding ranges of preset acceptable values, the control unit 70 will activate the activating mechanism 50. Simultaneously, the control unit 70 will send a signal to the receiver 62 via the transmitter 60 to sound the alarm 64.

Likewise, the control unit 70 is capable of forwarding a signal to both the activating mechanism 50 and to the transmitter 60 when the signal from the water contact sensor 58 indicates that the person 12 is actually in a body of water and when one of the real time pulse signal and/or the real time breathing signal, in combination with the real time body orientation signals, 54 and 56, are simultaneously outside corresponding ranges of preset acceptable values. Furthermore, the control unit 70 is capable of forwarding a signal to both the activating mechanism 50 and to the transmitter 60 when the signal from the water contact sensor 58 indicates that the person 12 is actually in a body of water and when all the other signals, i.e. the real time pulse signal, the real time breathing signal, the combination of the real time body orientation signals, 54 and 56, and the water pressure signal 60 are all simultaneously outside corresponding ranges of preset acceptable values.

Figure 6:
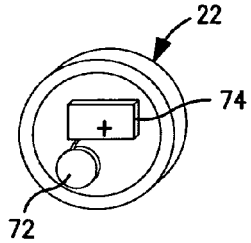
FIG. 6 is a perspective view of the back surface of a sensor with the cover removed to show a source of energy, i.e. a battery, electrically connected to the internal components of the sensor.

Referring now to FIG. 6, the water survival system 10 also includes a source of energy 72 connected to each of the sensors 22, 24, 54, 56, 58 and 60, to the activating mechanism 50, to the global positioning system (GPS) device 52, to the receiver 62, to the alarm 64, to the transmitter 68, and to the control unit 70. The source of energy 72 can be any source of energy commonly known to a person skilled in the art. For example, the source of energy 72 can be a battery. Desirably, the battery is a lithium battery. By "lithium battery" it is meant a battery formed from lithium which is a soft, highly reactive metallic element. In other words, any of the elements of the device 10 that need a source of energy 72 to operate for an extended period of time is equipped with a dedicated battery. Alternatively, one or more batteries can be connected to supply a source of energy 72 to the required elements. It is also possible to monitor the capacity of each of the sources of energy 72 (each battery) to make sure each is working properly. The control unit 70 can monitor the amount of power which is available at each element. The source of energy 72 can be directly or indirectly connected to the internal components 74 of each element. In FIG. 6, the rear cover of the pulse sensor 22 has been removed to show the source of energy 72 (battery) is connected to the internal components 74.

When the source of energy 72 is a battery, the battery can be relatively small in size. Usually, the battery can be a thin disc having a diameter of about 0.5 inches or less. Such batteries are commonly used to power wrist watches, alarm clocks, etc. and have a working life of a year or more before they have to be replaced.

Concerning the source of energy 72, it is a matter of constantly monitoring the battery to make sure that it has sufficient power to produce a reliable functioning device 10. When this is not the case, the control unit 70 can activate an internal alarm to signal low power or no power. Optionally, the control unit 70 can send a signal via the transmitter 68 to the receiver 62 to activate an alarm to provide notice to a rescue person that one or more of the batteries are low or not functioning properly.

The control unit 70 is capable of storing several ranges of preset acceptable values. The control unit 70 is also capable of forwarding a signal to both the activating mechanism 50 and to the transmitter 68 when a real time signal is outside a particular range of preset acceptable values. The signal to the activating mechanism 50 causes the supply of compressed gas to be opened so that the expandable chamber 44 can be inflated. The signal to the transmitter 68 is forwarded to the receiver 62 which sounds the audible alarm 64. A person monitoring the receiver 62 will dispatch help and assistance immediately to the person 12 wearing the life jacket 26. This help can be in the form of a life guard, a police officer, a fireman, an emergency medical team, etc. In one scenario, a life guard on a beach has a mobile receiver 62 and when the alarm 64 sounds, he or she runs into the water and provides assistance to the person wearing the life jacket 26. In another scenario, the receiver 62 is located on shore in a monitoring office by a dispatcher. When the alarm 64 is sounded, the dispatcher calls a medical team situated in a mobile vehicle, such as a rescue ambulance, and the medical team speeds to the location of the person 12 wearing the life jacket 26 to render assistance.

The water survival system 10 of this invention has an advantage over the known prior art in that it has the ability to monitor a greater number of sensors which can measure different functions and processes of a person 12 who may be in danger of drowning in a body of water. Therefore, the certitude for a rescue of the person 12 in time is substantially raised. Additionally, the signals being monitored cover both body functions of the person 12 and physical quantities providing information about the person 12 who may be in danger of drowning. When the measured signals exceed or are outside of a range of preset acceptable values, the water survival system 10 will transmit a signal from the control unit 70 via the transmitter 68 to the receiver 62 which in turn will activate the audible alarm 64. This alarm 64 will alert and enables rescue or aid personnel to reach and attend to the person 12 in danger. The aforementioned signals can be independent from the body functions of the person 12 and include the water contact sensor 58 to establish that the person 12 is actually in a body of water. The optional water pressure sensor 60 can establish the depth below the surface of the water that the person 12 is at and the speed at which the person 12 is sinking.

Figure 7:
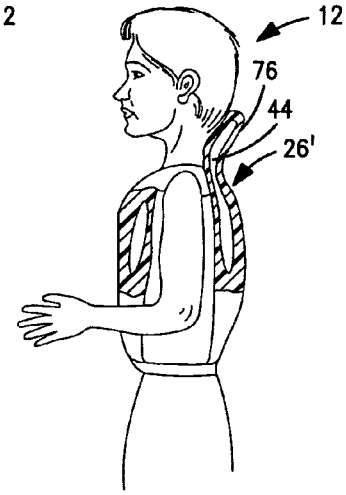
FIG. 7 is a side view of an alternative embodiment showing a person wearing a life jacket which includes a raised collar having the expandable chamber therein.
Figure 3:
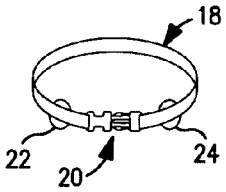
FIG. 3 is a perspective view of the breast belt in an open position.

Referring to FIG. 7, an alternative embodiment of a life jacket 26' is shown which includes a raised collar 76. The raised collar 76 can vary in size, shape and configuration. The raised collar 76 can be integrally formed with the life jacket 26' or be an attachment thereto. Desirably, the raised collar 76 will extend in an arc from approximately the left jaw bone around the back of the person's neck to approximately the right jaw bone. The presence of the raised collar 76 around the back of the neck will help position the face, especially the mouth, nose, eyes and ears of the person 12 above the surface of the water. The expandable chamber 44 in the life jacket 26' may optionally extend into at least a portion of the raised collar 76. Desirably, the expandable chamber 44 will extend into the raised collar 76. Alternatively, the raised collar 76 can have its own expandable chamber 44 which is connected to an independent container of compressed gas or be connected by a separate conduit to the container of compressed gas 46. When the compressed gas is routed into the expandable chamber 44 of the raised collar 76, the raised collar 76 will expand and enlarge in size. This action will increase the buoyancy of the person 12. The enlargement of the raised collar 76 can also expand the area of the raised collar 76 so that it more fully surrounds the back portion of the neck of the person 12. This extra flotation will ensure that the head of the person 12 will be lifted up out of the water so that the person 12 can continue to breath. The raised collar 76 will also cause the position of the face of the person 12 to face upwardly away from the surface of the water.

Referring now to FIG. 8, a flow diagram is shown which depicts the method of detecting the danger of a person 12 drowning in a body of water. The person 12 has a pair of shoulders 14, 14 and a pair of hips 16, 16. The method includes the steps of securing a breast belt 18 about a chest of the person 12. The breast belt 18 has a first sensor 22 capable of measuring a real time physiological condition of the person 12 wearing the breast belt 18. The first, sensor 22 can be a pulse sensor. A breathing sensor 24 can also be secured to the breast belt 18. The breathing sensor 24 measures another physiological condition of the person 12 wearing the breast belt 18. Positioning a life jacket 26 about a torso of the person 12 and external to the breast belt 18. The life jacket 26 having a front section 34, a back section 36, and a pair of shoulder straps 38, 38 joining the front section 34 to the back section 36. At least one of the front and back sections, 34 and 36 respectively, has a first surface 40 and a second surface 42 with an expandable chamber 44 located therebetween. A supply of compressed gas 46 is connected to the expandable chamber 44. An activating mechanism 50 is present which is capable of opening the supply of compressed gas 46 and allowing the compressed gas to expand and be routed to the expandable chamber 44 to increase the buoyancy of the life jacket 26.

The method also includes attaching a global positioning system (GPS) device 52 to the life jacket 26. The global positioning system (GPS) device 52 is capable of determining real time longitude and latitude coordinates of the person 12 wearing the life jacket 26. The method further includes attaching a first body orientation sensor 54 to the life jacket 26 approximate one of the pair of shoulders 14, 14 and attaching a second body orientation sensor 56 to the life jacket 26 approximate one of the pair of hips 16, 16. The first and second body orientation sensors, 54 and 56 respectively, cooperate to determine real time body orientation values of the person 12 wearing the life jacket 26. The method also includes attaching a water contact sensor 58 to the life jacket 26 which is capable of determining when the person 12 is actually in a body of water. A receiver 62 is remotely located away from the person 12 wearing both the breast belt 18 and the life jacket 26. The receiver 62 has an audible alarm 64 connected thereto. The method further includes attaching a transmitter 68 to the life jacket 26 which is capable of sending a wireless signal to the receiver 62.

One then establishes several ranges of preset acceptable values for the person 12 wearing both the breast belt 18 and the life jacket 26. The corresponding ranges, each having preset acceptable values, includes at least one physiological condition value, and a combination of first and second body orientation values. The method also includes attaching a control unit 70 to the life jacket 26 which is capable of receiving a real time signal from at least one of the physiological condition sensors 22 and 24, and comparing the received signals against a range of preset acceptable values to determine if the real time signal indicates that the person 12 wearing the breast belt 18 may be in danger of drowning. The method further includes using the control unit 66 to receive real time signals from the first and second body orientation sensors, 54 and 56 respectively, and comparing the received signals against a range of preset acceptable values to determine if a real time signal indicates that the person 12 wearing the life jacket 26 may be in danger of drowning. The method also includes attaching a global positioning system (GPS) device 52 to the life jacket 26 which is capable of determining longitude and latitude coordinates of the person 12 wearing the life jacket 26 and generating real time longitude and latitude coordinates. The control unit also receives a signal from the water contact sensor 58 which alerts the control unit 70 that the person 12 is in the water. This signal must indicate that the person 12 is in the water before the control unit 70 is armed. If this signal indicates that the person 12 is not in the water, then none of the other signals inputted into the control unit 70 will be forwarded to the activating mechanism 50 or to the receiver 62 via the transmitter 68.

When the signal from the water contact sensor 58 indicates that the person 12 is in the water, and the signal from one of the physiological sensors 22 and/or 24 is outside of the corresponding range of preset acceptable values, and the signal from the first and second body orientation sensors, 54 and 56 respectively, indicate a change in body orientation, then the control unit 70 will send a signal to the activating mechanism 50 which causes the supply of compressed gas 46 to be routed through a conduit 48 to the expandable chamber 44. This action increases the buoyancy of the life jacket 26. Simultaneously, a signal is sent from the control unit 70 via the transmitter 68 to the receiver 62. This action will alert the rescue personnel that assistance is required.

Figure 9:
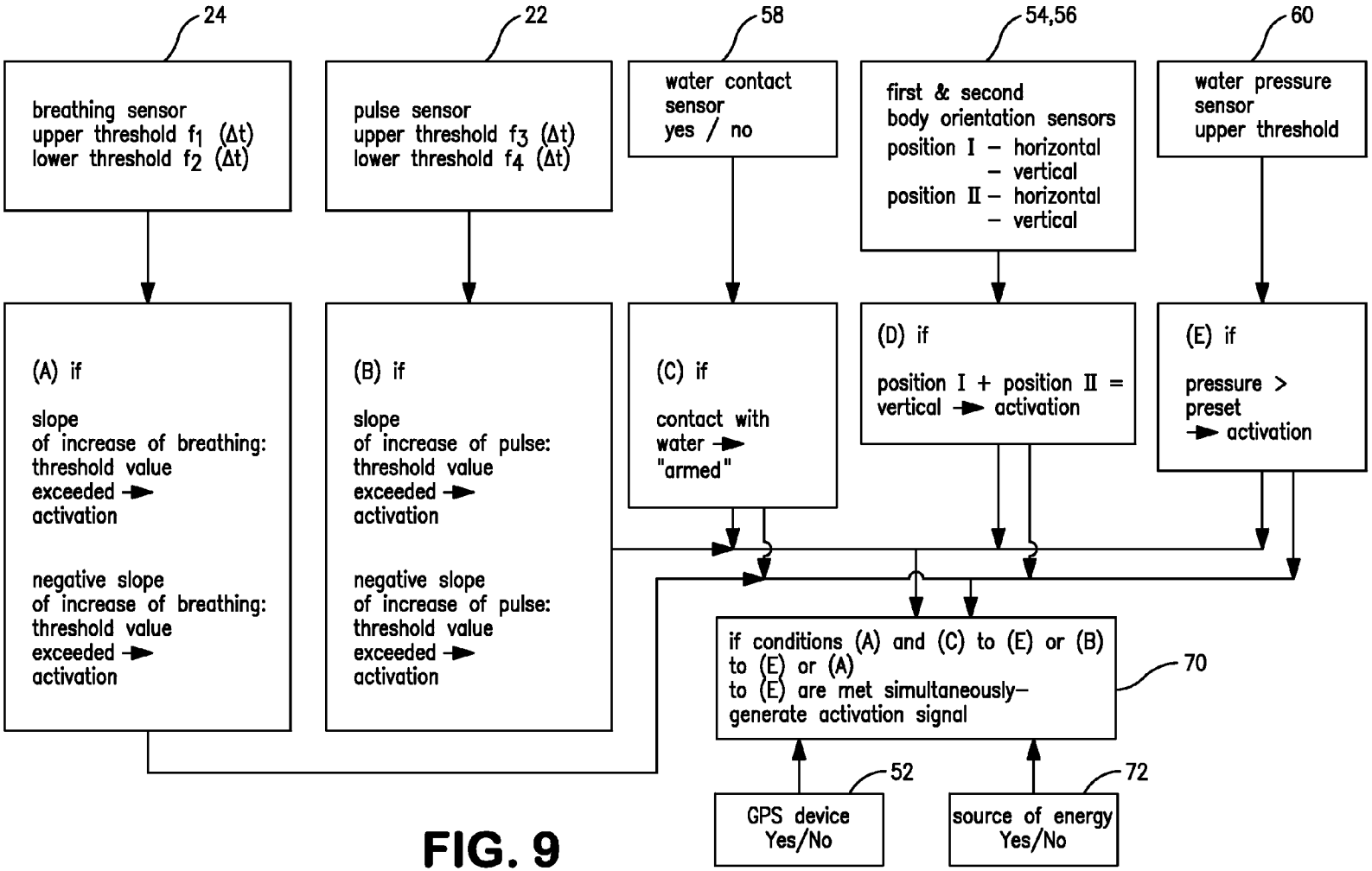
FIG. 9 is a flow chart which depicts under what conditions the activating mechanism is triggered.

Referring now to FIG. 9, a flow chart is shown which depicts under what conditions the activating mechanism 50 is triggered. With the water survival system 10, at least three of the five measured signals from: the pulse sensor 22; the breathing sensor 24; the first and second body orientation sensors, 54 and 56 respectively; the water contact sensor 58; and the water pressure sensor 60 must be met simultaneously.

Of the five signals, the signal from the water contact sensor 58 to the control unit 70 is mandatory. The water contact sensor 58 must indicate that the person 12 wearing the life jacket 26 is actually in the water. The five ranges of preset acceptable values are programmed into the control unit 70. In addition, the control unit 70 measures the source of energy 72 in each element to assure that it is working. If not, a signal is sent to the receiver 62 and an audible alarm can be activated. In addition, an alarm built into the control unit 70 can be activated to alert whoever is wearing the breast belt 18 and the life jacket 26, that the batteries are low or out of power. The global positioning system (GPS) device 52 must also be functioning and sending a signal to the control unit 70. Again, if it is not, the control unit 70 can produce a warning, such as an alarm, to notify the person 12 that the device 10 is not functioning properly.

In FIG. 9, the water survival system 10 functions as follows: condition (A) relates to the breathing sensor 24; condition (B) relates to the pulse sensor 22; condition (C) relates to the water contact sensor 58; condition (D) relates to the first and second body orientation sensors 54 and 56; and condition (E) relates to the water pressure sensor 60. The water contact sensor 58 detects whether the person 12 is actually in a body of water. When this is the case, then condition (C) is fulfilled which means that the control unit 70 is "armed" and the functional units necessary for the observation of the person 12 are activated. The breathing sensor 24 continuously measures the breathing frequency of the person 12. The pulse sensor 22 continuously measures the pulse frequency of the person 12. Each of the first and second body orientation sensors, 54 and 56 respectively, continuously measure the body orientation of the person 12 to determine if the orientation is horizontal or vertical. Position I (the hip area 16) is measured by the second body orientation sensor 56 and position II (the shoulder area 14) is measured by the first body orientation sensor 54. Lastly, the water pressure sensor 60 continuously measures the water pressure at a location approximate the pair of hips 16, 16 of the person 12. The condition (A) is fulfilled if the breathing frequency of the person 12 exceeds an upper threshold value f ($\Delta t$) or falls below a lower threshold value $f_2$ ($\Delta t$). The condition (B) is fulfilled if the pulse frequency of the person 12 exceeds an upper threshold value $f_3$ ($\Delta t$) or falls below a lower threshold value $f_4$ ($\Delta t$). The condition (D) is fulfilled if both of the first and second body orientation sensors, 54 and 56 respectively, each measure the vertical body orientation of the person 12. The condition (E) is fulfilled if the water pressure sensor 60 measures a water pressure exceeding a range of preset acceptable values.

When conditions (A) as well as (C), (D) and (E) are fulfilled, or the conditions (B), (C), (D) and (E) are fulfilled, which is detected by the evaluation and comparison within the control unit 70, then the control unit 70 sends a signal to the activating mechanism 50 and a signal to the transmitter 68. The signal to the transmitter 68 is forwarded to the receiver 62 which activates the alarm 64. The receiver 62 can also visually display the current critical data on monitor 66. The signal to the activating mechanism 50 causes the supply of compressed gas to be opened and routed through the conduit 48 to the expandable chamber 44. This action will inflate the life jacket 26 and increase buoyancy thereof causing the person 12 to be lifted to the surface of the water so that the person 12 can breathe.

Simultaneous with sending a signal to the transmitter 68, the current position of the person 12 in the water is transferred to the receiver 62 via the control unit 70 from the global position system (GPS) device 52. Desirably, the receiver 62 is a mobile telephone equipped with a display or a similar mobile device. The global position system (GPS) device at the receiver 62 may be able to generate an arrow and number display, as in a conventional navigation system of a vehicle, that indicates the direction and distance (in feet or meters) to the person 12 in danger. The arrow display is continuously directed toward the location of the person 12. Therefore, a rescue person can quickly locate the person 12 in the water and initiate corresponding rescue actions.

The water survival system 10 and the method may also be designed such that except for condition (C), only a selection of the remaining conditions (A), (B), (D) and (E) must be fulfilled in order for the control unit 70 to send a signal to the activating mechanism 50 and to the transmitter 68.

While the invention has been described in conjunction with a single embodiment, it is to be understood that many alternatives, modifications and variations will be apparent to those skilled in the art in light of the foregoing description. Accordingly, this invention is intended to embrace all such alternatives, modifications and variations which fall within the spirit and scope of the appended claims.

We claim:

1. A water survival capable of detecting a danger of a person drowning in a body of water, said person having a pair of shoulders and a pair of hips, said water survival system comprising:

a) a breast belt capable of being opened and closed so as to secure said breast belt about a chest of said person, and said breast belt having a first sensor capable of measuring a real time physiological condition of said person wearing said breast belt and producing a corresponding real time signal;

b) a life jacket positioned about a torso of said person and external to said breast belt, said life jacket having a front section, a back section, and a pair of shoulder straps joining said front section to said back section, at least one of said front and back sections of said life jacket having a first surface and a second surface with an expandable chamber located therebetween, a supply of compressed gas connected to said expandable chamber, an activating mechanism capable of opening said supply of compressed gas and allowing said compressed gas to expand and be routed to said expandable chamber to increase the buoyancy of said life jacket;

c) a global positioning system device attached to said life jacket which is capable of determining real time longitude and latitude signal coordinates of said person wearing said life jacket;

d) a first body orientation sensor attached to said life jacket and located approximate one of said pair of shoulders and a second body orientation sensor attached to said life jacket and located approximate one of said pair of hips, said first and second body orientation sensors generating real time body orientation signals for said person wearing said life jacket;

e) a water contact sensor attached to said life jacket which is capable of determining when said person is in a body of water and producing a corresponding real time signal;

f) a receiver located remotely away from said person wearing both said breast belt and said life jacket, said receiver having an audible alarm connected thereto;

g) a transmitter attached to said life jacket which is capable of sending a signal to said receiver;

h) a control unit attached to said life jacket which is capable of receiving real time signals from each of said sensors, said control unit capable of processing said real time signals and comparing them against corresponding ranges of preset acceptable values to determine if said person wearing both said breast belt and said life jacket is in danger of drowning, said control unit capable of forwarding a signal to both said activating mechanism and to said transmitter when said signal from said water contact sensor indicates that said person is actually in a body of water and when said other real time signals are simultaneously outside corresponding ranges of preset acceptable values, said signal to said activating mechanism opening said supply of compressed gas and said signal to said transmitter being forwarded to said receiver which sounds said audible alarm; and i) a source of energy connected to each of said sensors, to said activating mechanism, to said global positioning system device, and to said control unit to allow each to operate for an extended period of time.

2. The water survival system of claim 1 wherein said first body orientation sensor operates at a different voltage level than said second body orientation sensor, and each of said first and second body orientation sensors operates at a voltage level from between about 0 to about 4 volts.

3. The water survival system of claim 1 wherein said life jacket includes a raised collar and said expandable chamber extends into at least a portion of said raised collar, and when said compressed gas is routed into said expandable chamber located in said raised collar, said raised collar will expand and at least partially surround a neck of said person and assist in positioning a face of said person in an upwardly facing position away from a surface of said body of water.

4. The water survival system of claim 1 wherein said control unit is capable of monitoring said source of energy to make sure it is functioning.

5. The water survival system of claim 1 wherein said life jacket includes a water pressure sensor capable of determining a real time value indicating a water depth of said person wearing said life jacket when in a body of water, and said control unit capable of forwarding a signal to both said activating mechanism and to said transmitter when said water contact sensor indicates that said person is actually in a body of water and when at least two of said remaining real time signals are simultaneously outside corresponding ranges of preset acceptable values.

6. The water survival system of claim 5 wherein said water pressure sensor is also capable of determining a real time value indicating a sinking speed of said person wearing said life jacket when in a body of water.

7. The water survival system of claim 1 wherein said transmitter is a UHF transmitter which transmits electromagnetic waves from between 300 MHz to 3 GHz.

8. The water survival system of claim 1 wherein said transmitter is a VHF transmitter which transmits electromagnetic waves between 30 MHz to 300 MHz.

9. The water survival system of claim 1 wherein said activating mechanism is pyrotechnically activated.

10. A water survival system capable of detecting a danger of a person drowning in a body of water, said person having a pair of shoulders and a pair of hips, said water survival system comprising:

a) a breast belt which can be opened and closed to secure said breast belt about a chest of said person, said breast belt having a pulse sensor and a breathing sensor attached thereto, said pulse sensor capable of measuring real time pulse frequencies of said person wearing said breast belt and producing a corresponding real time signal, and said breathing sensor capable of measuring real time breathing frequencies of said person wearing said breast belt and producing a corresponding real time signal;

b) a life jacket positioned about a torso of said person and external to said breast belt, said life jacket having a front section, a back section, and a pair of shoulder straps joining said front section to said back section, at least one of said front and back sections of said life jacket having a first surface and a second surface with an expandable chamber located therebetween, a supply of compressed gas connected to said expandable chamber, an activating mechanism capable of opening said supply of compressed gas and allowing said compressed gas to expand and be routed to said expandable chamber to increase the buoyancy of said life jacket;

c) a global positioning system device attached to said life jacket which is capable of determining real time longitude and latitude coordinates of said person wearing said life jacket and producing corresponding real time signals;

d) a first body orientation sensor attached to said life jacket and located approximate one of said pair of shoulders and a second body orientation sensor attached to said life jacket and located approximate one of said pair of hips, said first and second body orientation sensors generating real time body orientation signals of said person wearing said life jacket;

e) a water contact sensor attached to said life jacket which is capable of determining when said person is in a body of water and producing a corresponding real time signal;

f) a receiver located remotely away from said person wearing both said breast belt and said life jacket, said receiver having an audible alarm connected thereto;

g) a transmitter attached to said life jacket which is capable of sending a wireless signal to said receiver;

h) a control unit attached to said life jacket which is capable of receiving real time signals from each of said sensors, said control unit capable of processing said real time signals and comparing them against corresponding ranges of preset acceptable values to determine if said person is in danger of drowning, said control unit capable of forwarding a signal to both said activating mechanism and to said transmitter when said signal from said water contact sensor indicates that said person is actually in a body of water and when one of said real time pulse signal or said real time breathing signal, in combination with said real time body orientation signals, are simultaneously outside corresponding ranges of preset acceptable values, said signal to said activating mechanism opening said supply of compressed gas and said signal to said transmitter causing a wireless signal to be sent to said receiver which causes said audible alarm to sound; and i) a source of energy connected to each of said sensors, to said activating mechanism, to said global positioning system device, and to said control unit to allow each to operate for an extended period of time.

11. The water survival system of claim 10 wherein said breathing sensor measures breathing frequency based on both abdominal and breast breathing of said person wearing said breast belt.

12. The water survival system of claim 10 wherein said activating mechanism is electrically activated.

13. The water survival system of claim 10 wherein said receiver visually displays said receives signals from said transmitter.

14. The water survival system of claim 10 wherein each of said sources of energy is a battery.

15. The water survival system of claim 14 wherein each of said batteries is a lithium battery.

16. A method of detecting the danger of a person drowning in a body of water, said person having a pair of shoulders and a pair of hips, said method comprising the steps of:

a) securing a breast belt about a chest of said person, said breast belt having a first sensor capable of measuring a real time physiological condition of said person wearing said breast belt and producing a corresponding real time signal;

b) positioning a life jacket about a torso of said person and external to said breast belt, said life jacket having a front section, a back section, and a pair of shoulder straps joining said front section to said back section, at least one of said front and back sections having a first surface and a second surface with an expandable chamber located therebetween, a supply of compressed gas connected to said expandable chamber, and an activating mechanism capable of opening said supply of compressed gas and allowing said compressed gas to expand and be routed to said expandable chamber to increase the buoyancy of said life jacket;

c) attaching a global positioning system device to said life jacket which is capable of determining real time longitude and latitude coordinates of said person wearing said life jacket and producing corresponding real time signals;

d) attaching a first body orientation sensor to said life jacket approximate one of said pair of shoulders and attaching a second body orientation sensor to said life jacket approximate one of said pair of hips, said first and second body orientation sensors generating real time body orientation values of said person wearing said life jacket and producing corresponding real time signals;

e) attaching a water contact sensor to said life jacket which is capable of determining when said person is in a body of water and producing a corresponding real time signal;

f) locating a receiver remotely away from said person wearing both said breast belt and said life jacket, said receiver having an audible alarm connected thereto;

g) attaching a transmitter to said life jacket which is capable of sending a wireless signal to said receiver;

h) establishing ranges of preset acceptable values for said person wearing both said breast belt and said life jacket, said ranges of preset acceptable values including a physiological condition value and first and second body orientation values; and i) attaching a control unit to said life jacket which is capable of receiving real time signals from each of said sensors, said control unit capable of processing said real time signals and comparing them against corresponding ranges of preset acceptable values to determine if said person is in danger of drowning, said control unit capable of forwarding a signal to both said activating mechanism and to said transmitter when said signal from said water contact sensor indicates that said person is actually in a body of water and when said real time physiological condition signal and said real time body orientation signals are simultaneously outside corresponding ranges of preset acceptable values, said signal to said activating mechanism opens said supply of compressed gas and said signal to said transmitter causing a wireless signal to be sent to said receiver which causes said audible alarm to sound.

17. The method of claim 16 wherein said signal sent from said control unit to said transmitter is forwarded onto said receiver and said audible alarm is sounded.

18. The method of claim 16 further comprising attaching a water pressure sensor to said life jacket which is capable of determining water depth of said person wearing said life jacket when in a body of water.

19. The method of claim 18 wherein said water pressure sensor is capable of determining a sinking speed of said person wearing said life jacket when in a body of water.

20. The method of claim 16 wherein said activating mechanism is pyrotechnically activated.

* * * * *